US011525425B2

(12) United States Patent
Ito et al.

(10) Patent No.: US 11,525,425 B2
(45) Date of Patent: Dec. 13, 2022

(54) AIR CLEANER

(71) Applicants: Mahle International GmbH, Stuttgart (DE); Mahle Filter Systems Japan Corporation, Tokyo (JP)

(72) Inventors: Noritake Ito, Tokyo (JP); Mihiro Kataoka, Tokyo (JP); Junji Yoshida, Tokyo (JP)

(73) Assignees: Mahle International GmbH; Mahle Filter Systems Japan Corp.

( * ) Notice: Subject to any disclaimer, the term of this patent is extended or adjusted under 35 U.S.C. 154(b) by 59 days.

(21) Appl. No.: 17/109,122

(22) Filed: Dec. 1, 2020

(65) Prior Publication Data

US 2021/0164424 A1 Jun. 3, 2021

(30) Foreign Application Priority Data

Dec. 2, 2019 (JP) ..... JP2019-217762

(51) Int. Cl.
*F02M 35/02* (2006.01)
*F02M 35/024* (2006.01)

(52) U.S. Cl.
CPC .... *F02M 35/0204* (2013.01); *F02M 35/0207* (2013.01); *F02M 35/02416* (2013.01); *F02M 35/02491* (2013.01)

(58) Field of Classification Search
CPC ..... F02M 35/0204; F02M 35/0207; F02M 35/02416; F02M 35/02491; F02M 35/021; F02M 35/0201; F02M 35/0202
See application file for complete search history.

(56) References Cited

U.S. PATENT DOCUMENTS 4,897,097 A * 1/1990 Yamamura ..... F02M 35/0215 55/484
6,866,694 B2 * 3/2005 Moreau ..... F02M 35/024 55/497
8,052,780 B2 * 11/2011 Rotter ..... F02M 35/022 55/502

(Continued)

FOREIGN PATENT DOCUMENTS

DE 102017011876 A1 * 8/2018 ..... B01D 46/0019
EP 3339623 A1 * 6/2018 ..... F02M 35/0202
JP 2014-40779 A 3/2014

OTHER PUBLICATIONS

English abstract for JP-2014-40779.

*Primary Examiner* — Hung Q Nguyen
(74) *Attorney, Agent, or Firm* — Fishman Stewart PLLC

(57) ABSTRACT

An air cleaner may include a filter element and a housing defining an inner space. The inner space may be divided by the filter element into a dust-side air chamber on an upstream side and a clean-side air chamber on a downstream side. Air introduced into the housing may be dischargable via an outlet pipe, to which an air flow sensor is attachable, connected to the clean-side air chamber. The outlet pipe may extend in a direction different from a normal to the filter element. A plurality of ribs may be disposed on an inner surface of a clean-side portion of the housing that defines the clean-side air chamber. The plurality of ribs may extend from a corner portion of the housing toward the filter element and the outlet pipe. A distance between adjacent ribs of the plurality of ribs may decrease in a direction toward the outlet pipe.

20 Claims, 5 Drawing Sheets

(56) References Cited

U.S. PATENT DOCUMENTS

| | | | | |
|---|---|---|---|---|
| 2004/0065288 | A1* | 4/2004 | Kino | F02M 35/1266 181/204 |
| 2015/0013294 | A1* | 1/2015 | Schmid | F02M 35/0201 55/502 |
| 2019/0186447 | A1* | 6/2019 | Kwak | F02M 35/1216 |
| 2019/0293032 | A1* | 9/2019 | Kamiya | B01D 35/30 |
| 2020/0173402 | A1* | 6/2020 | Sudou | F02M 35/02416 |

* cited by examiner

AIR CLEANER

CROSS-REFERENCE TO RELATED APPLICATIONS

This application claims priority to Japanese Patent Application No. JP 2019-217762, filed on Dec. 2, 2019, the contents of which is hereby incorporated by reference in its entirety.

TECHNICAL FIELD

The present invention relates to an air cleaner and specifically relates to an air cleaner for an air intake system of an internal combustion engine, the air cleaner including an outlet pipe to which an air flow sensor is attachable.

BACKGROUND

In an air intake system of an internal combustion engine, an air cleaner is provided to remove dust in air taken in from the outside before the air is supplied to the internal combustion engine. In an outlet pipe of the air cleaner and/or a path of the air intake system from the outlet pipe to the internal combustion engine, an air flow sensor (MAF (mass air flow) sensor) that measures an amount of air to be supplied to the internal combustion engine is provided. In recent years, in order to enhance fuel efficiency of an internal combustion engine and make exhaust gas cleaner, a required accuracy of air amount measurement becomes high and there is a demand for curbing individual variation among air cleaners. In particular, in an air cleaner with an MAF sensor incorporated in an outlet pipe, it is necessary that a flow velocity distribution of air flow in the outlet pipe be uniform in transverse section; however, unevenness in flow velocity distribution of air flow occurs due to a structure of a housing of the air cleaner and heterogeneity of a filter element.

For example, in an air cleaner having a structure in which an axis of an outlet pipe faces in a direction that is different from a normal to a flat plate-like filter element, air flow flows in the outlet pipe at an angle after passage through the filter element, unevenness in flow velocity distribution of air flow occurs in transverse section of the outlet pipe. Further, since the filter element is a resistor that interrupts a flow of air, a magnitude of resistance is not uniform within a plane of the filter element, and further because of individual variability, unevenness occurs in flow velocity distribution of air flow after passage through the filter element. Such unevenness in flow velocity distribution of air flow due to the structure of the air cleaner and heterogeneity of the filter element is particularly significant in the outlet pipe to which an MAF sensor is attached, and thus, curbing of unevenness in flow velocity distribution of air flow inside the outlet pipe has been demanded.

Therefore, curbing of unevenness in flow velocity distribution has been attempted by providing a flow straightening structure such as a metal mesh or a resin molded component in an entrance of an outlet pipe, or as described in Patent Reference 1, providing a flow straightening plate inside a clean-side air chamber.

CITATION LIST

Patent Reference

[Patent Reference 1] Japanese Patent Application Laid-Open Publication No. 2014-40779

However, since a flow straightening component such as a flow straightening structure or a flow straightening plate is a resistor that interrupts a flow of air, a flow of air is largely hindered particularly when an air flow rate is low. Moreover, when the flow straightening component is made as a part that is separate from a housing, it is necessary to fix the separate flow straightening component to the housing, which causes an increase in number of components and complication of a manufacturing process. In case the flow straightening component is provided in an entrance of an outlet pipe, it is possible to prevent an increase in number of components and complication of the manufacturing process by molding the flow straightening component integrally with the housing; however, unevenness in flow velocity distribution may occur due to a molding state (for example, a burr), and furthermore, a distance from the entrance of the outlet pipe to an MAF sensor is small, and thus, the MAF sensor is largely affected by the unevenness in flow velocity distribution, which causes a problem of a secondary problem such as deterioration in measurement accuracy.

Moreover, as a result of the applicant's study, it has turned out that unevenness in flow velocity distribution of air flow due to heterogeneity of a filter element depends on a flow rate of air flow. FIG. 5 is a diagram indicating variation of values of measurement by an MAF sensor before and after attachment of a filter element after being rotated by 180 degrees. In the figure, the abscissa axis represents a magnitude of an air flow rate and the ordinate axis represents ratios dQ/Q of deviations dQ of a measurement value before the rotation of the filter element 71 and a measurement value after the rotation of the filter element 72 to an average value Q of the values of measurement by the MAF sensor before and after the rotation of the filter element. It can be understood that, in case the air flow rate is low, dQ/Q is small both before and after the rotation and the deviations become larger as the air flow rate is higher. From this result, it can be understood that unevenness in flow velocity distribution of air flow due to heterogeneity of the filter element becomes significant when the air flow rate is high. Furthermore, when the air flow rate is low, air passed through the filter element flows directly toward the outlet pipe while changing in flow direction, and thus, unevenness in flow velocity distribution is small; however, when the air flow rate is high, a flow toward the outlet pipe along the inner surface of the housing is generated, and thus, unevenness in flow velocity distribution becomes large.

Therefore, in order to reduce unevenness in flow velocity distribution due to the structure of the air cleaner and the heterogeneity of the filter element and enhance measurement accuracy of the MAF sensor, it is important to straighten an air flow at a point at which when an air flow rate is high, disturbance of air occurs, that is, a corner portion of a housing, the corner portion being distant from the outlet pipe and the filter element.

SUMMARY

The above problem can be solved by an air cleaner (1), an inner space of the air cleaner (1), the inner space being defined by housings (2, 3), being divided into a dust-side air chamber (33) on an upstream side and a clean-side air chamber (23) on a downstream side by a filter element (4), air introduced to the dust-side air chamber (33) being filtered by the filter element (4) and made to flow into the clean-side air chamber (23) and being discharged from an outlet pipe (21) to which an air flow sensor (22) is attachable, the outlet pipe (21) being connected to the clean-side air chamber (23), wherein the air cleaner is configured such that: the outlet pipe (21) extends in a direction that is different from a direction of a normal (52) to the filter element (4); the air cleaner (1) includes a plurality of ribs (41, 42, 43) disposed at an inner surface of a housing (2) defining the clean-side air chamber (23); the plurality of ribs (41, 42, 43) extend from a corner portion (24) of the housing, the corner portion (24) being distant from the filter element (4) and the outlet pipe (21), toward the filter element (4) and the outlet pipe (21), and terminate short of a surface (25) of the housing, the outlet pipe (21) being connected to the surface; and a distance (d) between adjacent ribs narrows toward the outlet pipe (21).

Providing the ribs for flow straightening at a point at which when an air flow rate is high, disturbance of air occurs, that is, the corner portion of the housing, the corner portion being distant from the outlet pipe and the filter element, and making a distance (d) between adjacent ribs narrow toward the outlet pipe (21) enable guiding an air flow to the outlet pipe while curbing disturbance of air when the air flow rate is high. Accordingly, it becomes possible to reduce unevenness in flow velocity distribution inside the outlet pipe, enabling enhancement in measurement accuracy of an MAF sensor. Moreover, when the air flow rate is low, a major part of the air flow flows to the outlet pipe without flowing along the inner surface, and thus, the ribs, which are straightening members, do not interrupt the flow of air.

Here, it is desirable that the plurality of ribs (41, 42, 43) be molded integrally with the housing (2, 3). Accordingly, it is possible to prevent an increase in number of components and complication of a manufacturing process. Moreover, even if a molded rib has a molding burr, the rib is disposed away from the outlet pipe, and thus, the MAF sensor attached to the outlet pipe is hardly affected by disturbance of air flow occurring due to the molding burr.

Furthermore, it is desirable that the plurality of ribs (41, 42, 43) extend symmetrically with respect to an axis (51) of the outlet pipe. It is possible to create a flow converging symmetrically with respect to the axis (51) of the outlet pipe, enabling reducing unevenness in flow velocity distribution in the outlet pipe.

Furthermore, it is desirable that respective end portions (45) on the outlet pipe (21) side of the ribs (41, 42, 43) extend from the inner surface of the housing in a direction away from the outlet pipe (21). Accordingly, it is possible to prevent the end portions of the ribs from reaching the vicinity of an entrance of the outlet pipe, enabling reducing unevenness in flow velocity distribution in the outlet pipe.

DETAILED DESCRIPTION

Figure 1:
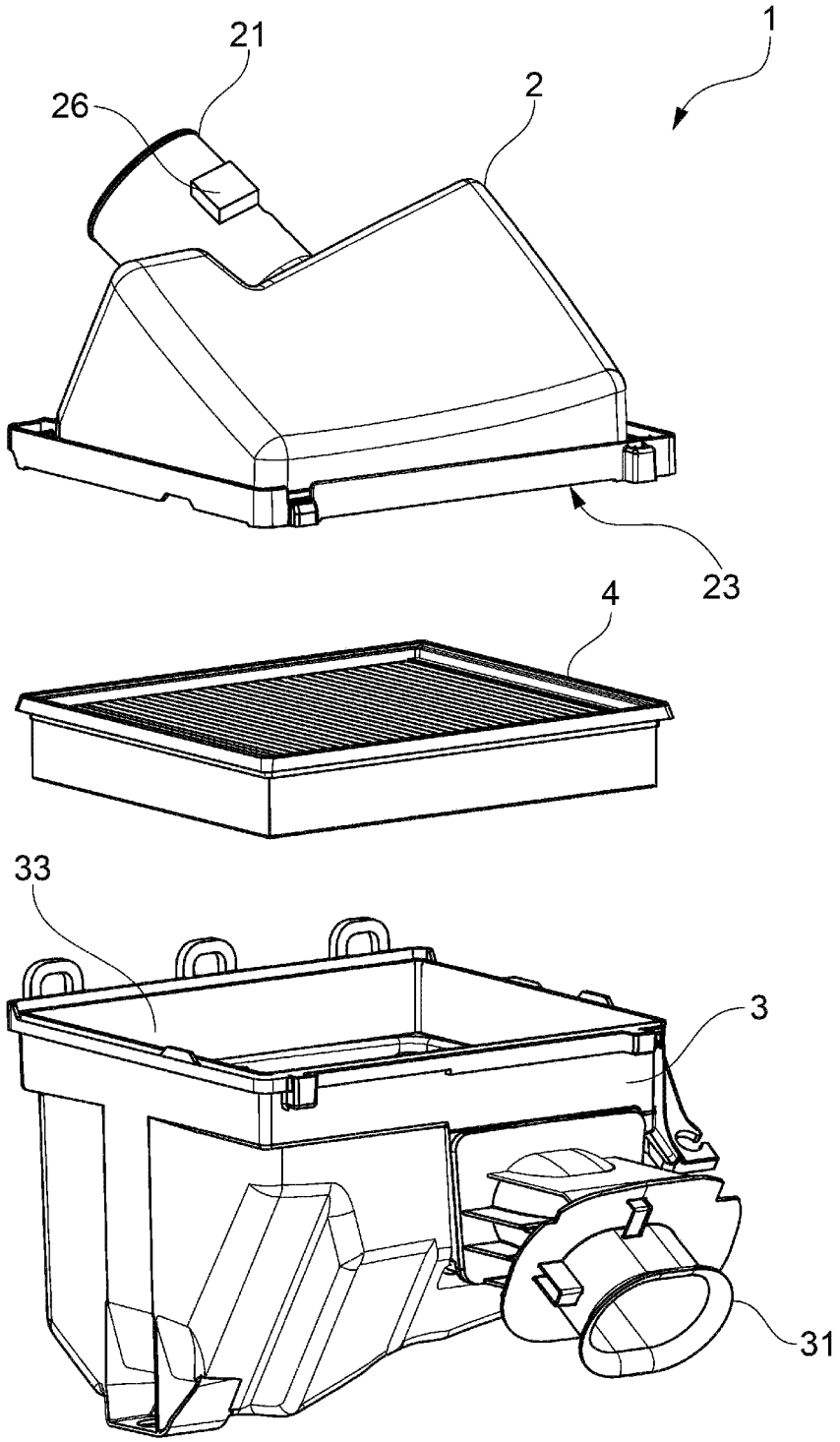
FIG. 1 is a schematic exploded perspective view of an air cleaner.
Figure 2:
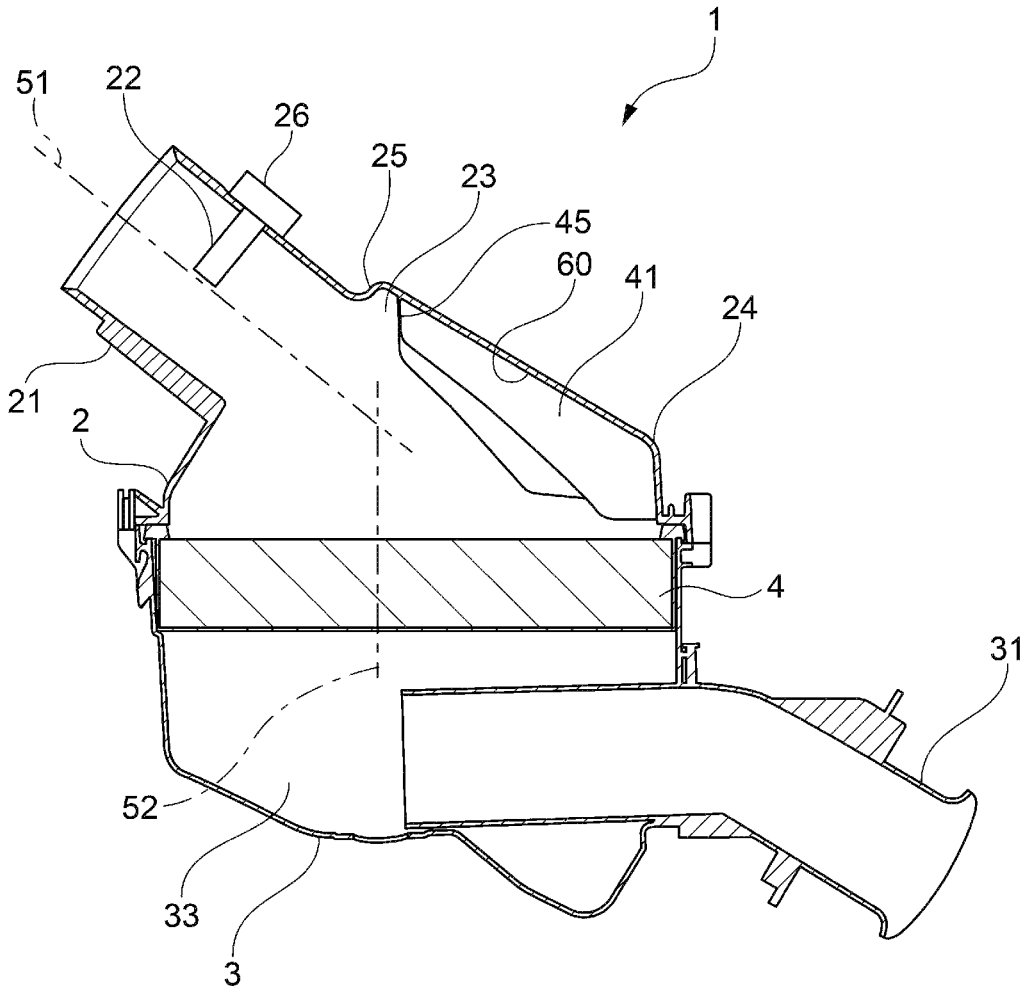
FIG. 2 is a schematic sectional view of an air cleaner.

FIGS. 1 and 2 illustrate a schematic configuration of an air cleaner 1 according to an embodiment of the present invention. FIG. 1 is a schematic perspective view in which the air cleaner 1 is disassembled into major components and FIG. 2 is a schematic sectional view of the air cleaner 1 as cut in a vertical direction.

The air cleaner 1 comprises a clean-side housing 2, a lower portion of which opens, a dust-side housing 3, an upper portion of which opens, and a flat plate-like filter element 4 disposed in the inside of the housings. By a lower end portion of the clean-side housing 2 and an upper end portion of the dust-side housing 3 engaging with each other, respective openings of the housings are closed and an inner space of the air cleaner 1 is thereby defined.

The inner volume of the air cleaner 1 is divided into a dust-side air chamber 33 and a clean-side air chamber 23 by the filter element 4 disposed at a position of the closed openings. The dust-side air chamber 33, which is an air chamber on the upstream side, is defined by the filter element 4 and the dust-side housing 3. Moreover, the clean-side air chamber 23, which is an air chamber on the downstream side, is defined by the filter element 4 and the clean-side housing 2.

An inlet pipe 31 for taking in external air is connected to the dust-side housing 3 such that the inlet pipe 31 extends through the housing 3. External air containing dust taken in from the inlet pipe 31 flows into the filter element 4 through the dust-side air chamber 33.

The filter element 4 is a flat plate-like element including a flat upper surface and a flat lower surface, the flat plate-like element being formed by a filter member with folds formed in an accordion-like shape. The filter element 4 has a function that filters air by capturing dust in air flowing through the filter member.

An outlet pipe 21 that discharges air filtered by passing through the filter element 4 is connected to the clean-side housing 2. A direction in which the outlet pipe 21 extends, that is, an axis 51 of the outlet pipe 21 faces a direction that is different from a normal 52 to the flat plate-like filter element 4. Therefore, air passed through the filter element 4 flows toward the outlet pipe 21 while changing in direction in which the air flows inside the clean-side air chamber 23. The air discharged from the outlet pipe 21 is supplied to an internal combustion engine through an air intake system path.

A sensor attaching portion 26 to which an air flow sensor (MAF sensor) 22 is detachably attachable is provided at a peripheral surface of the outlet pipe 21. The MAF sensor 22 attached to the sensor attaching portion 26 extends toward the inside of the outlet pipe 21 and is capable to measure a flow rate of air flowing inside the outlet pipe 21.

Three ribs 41, 42, 43 extending perpendicularly from an inner surface 60 of the clean-side housing 2 are disposed at the inner surface 60. Although the number of ribs 41, 42, 43 in the air cleaner 1 of the present embodiment is three, the number of ribs can arbitrarily be set as long as the number is not less than two. Although in the air cleaner 1 of the present embodiment, the ribs 41, 42, 43 are molded integrally with the clean-side housing 2 using a material that is the same as a material of the clean-side housing 2 to prevent an increase in number of components and complication of a manufacturing process, it is possible to manufacture ribs 41, 42, 43 and a clean-side housing 2 individually using different parts and fix the ribs 41, 42, 43 and the clean-side housing 2 to each other via, e.g., welding.

Figure 3:
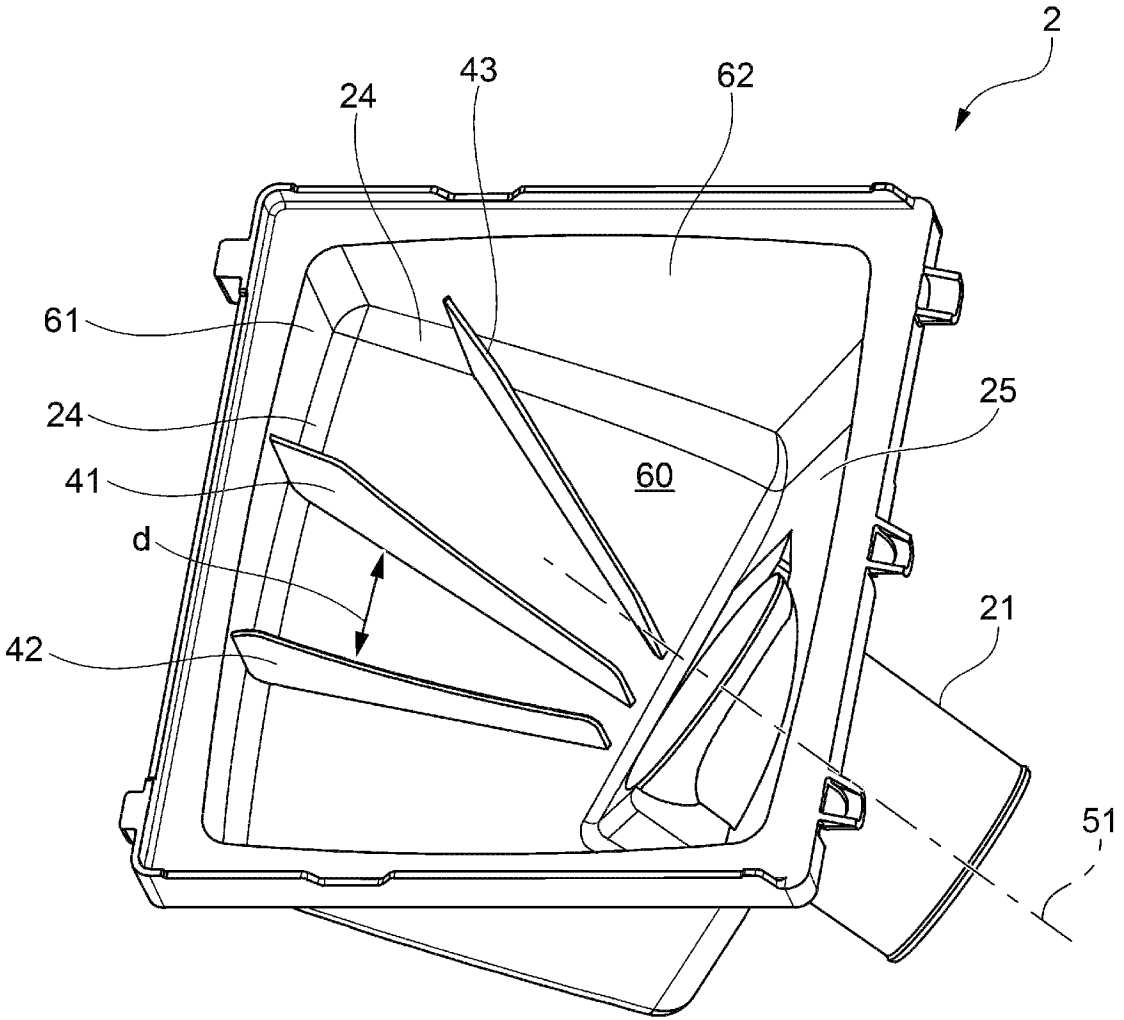
FIG. 3 is a perspective view schematically illustrating an inner surface of a clean-side housing.

FIGS. 2 and 3 illustrate an arrangement of the ribs 41, 42, 43. FIG. 3 is a schematic perspective view of the clean-side housing 2 as the inside of the clean-side housing 2 is viewed from the opening. The ribs 41, 42, 43 extend from relevant corner portions 24 of the clean-side housing 2, the corner portions 24 being distant from the filter element 4 and the outlet pipe 21, toward the filter element 4 and the outlet pipe 21 along inner surfaces 60, 61, 62 of the clean-side housing 2.

Here, each of the corner portions 24 of the housing 2 is a part of an edge at which two surfaces of the housing 2 meet. In other words, the rib 41 at a center and the rib 42 at one side extend from the corner portion 24 at which the surface 60 and the surface 61 meet, in a direction toward the filter element 4 along the surface 61 and toward the outlet pipe 21 along the surface 60. The rib 43 at another side extends from the corner portion 24 at which the surface 60 and the surface 62 meet, in a direction toward the filter element 4 along the surface 62 and toward the outlet pipe 21 along the surface 60.

The ribs 41, 42, 43 each extending in a direction toward the outlet pipe 21 terminate short of a surface 25 of the housing 2 to which the outlet pipe 21 is connected, without reaching the surface 25. Therefore, respective end portions 45 on the outlet pipe side of the ribs 41, 42, 43 are located at positions away from the outlet pipe 21. Therefore, an air flow in the vicinity of the outlet pipe 21 is not disturbed by the provision of the ribs 41, 42, 43. In particular, in case the ribs 41, 42, 43 are molded integrally with the clean-side housing 2, it is possible to prevent disturbance of an air flow in the vicinity of the outlet pipe 21 from occurring due to molding burrs that may be formed at end portions of the ribs. Consequently, it becomes possible to create a flow of air in which unevenness in flow velocity distribution inside the outlet pipe 21 is curbed.

On the other hand, the ribs 41, 42, 43 may extend in the respective directions toward the filter element 4 until the ribs 41, 42, 43 reach the filter element 4 (that is, to the opening of the clean-side housing 2). The filter element 4 has coarse/fine distribution because the filter material is formed in an accordion-like shape. Therefore, a magnitude of resistance when an air flow passes through the filter element 4 is not uniform within a plane of the filter element and further there is individual variation, unevenness occurs in flow velocity distribution of air flow after passage through the filter element 4. By making the ribs 41, 42, 43 extend to the vicinity of the filter element 4, it is possible to reduce unevenness in flow velocity distribution by straightening the air flow after passage through the filter element 4. Moreover, since the filter element 4 is distant from the outlet pipe 21, no effect of molding burrs of the ribs 41, 42, 43 is imposed on the air flow in the vicinity of the outlet pipe 21.

Respective distances d between adjacent ribs (between the ribs 41 and 42 and between the ribs 41 and 43) narrow toward the outlet pipe 21. This configuration enables the air flow inside the clean-side air chamber 23 to be straightened toward the outlet pipe 21 by the ribs 41, 42, 43 and thus enables curbing disturbance of the air flow in the vicinity of the outlet pipe 21 and reducing unevenness in flow velocity distribution of the air flow flowing inside the outlet pipe 21.

Furthermore, the ribs 41, 42, 43 of the present embodiment extend in respective directions that are symmetrical with respect to the axis 51 of the outlet pipe. In other words, the rib 41 at the center extends from the surface 61 in parallel with the axis 51 of the outlet pipe. The ribs 42, 43 at the sides extend toward the outlet pipe 21 such that respective distances d from the rib 41 at the center are equal to each other. Since flow rate of air flowing into the outlet pipe 21 from each side of the rib 41 at the center becomes substantially equal to each other, disturbance of air flow in the vicinity of the outlet pipe 21 is curbed and thus unevenness in flow velocity distribution of air flow flowing inside the outlet pipe 21 is reduced.

Moreover, the respective end portions 45 on the outlet pipe side of the ribs 41, 42, 43 extend from the inner surface 60 of the clean-side housing 2 in a direction away from the outlet pipe 21. In other words, the respective end portions 45 on the outlet pipe side of the ribs 41, 42, 43 extend from the inner surface 60 of the housing 2 not in a direction of a normal to the inner surface 60 but in a direction toward the side opposite to the outlet pipe 21 relative to the normal. Since the end portions 45 on the outlet pipe side of the ribs are located closest to the outlet pipe 21, if the end portions 45 are made to extend in the direction of the normal to the inner surface 60 of the housing 2, the end portions 45 become closer to the outlet pipe 21 as farther from the inner surface 60 of the housing, which cause disturbance of air flow in the vicinity of an entrance of the outlet pipe 21. Therefore, the end portions are made to extend from the inner surface of the housing in the direction away from the outlet pipe, enabling reduction of unevenness in flow velocity distribution of air flow flowing inside the outlet pipe 21.

Figure 4:
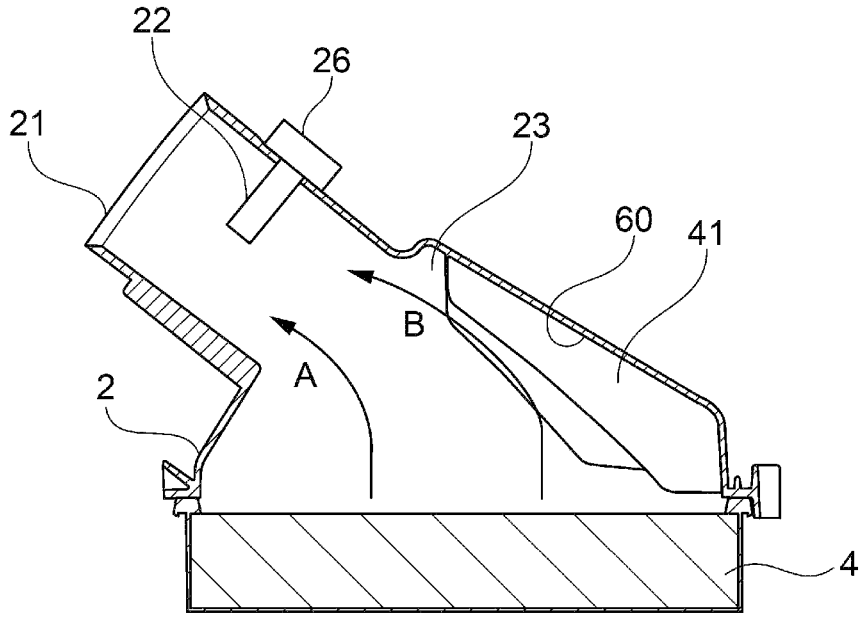
FIG. 4 is a diagram illustrating flows of air in a clean-side air chamber.

Next, effect of the ribs 41, 42, 43 of the air cleaner 1 will be described. FIG. 4 is a diagram of air flows in the clean-side air chamber 23. When a flow rate of air flowing in the air cleaner 1 is low, as indicated by arrow A, the air flow passed through the filter element 4 flows in the vicinity of a center portion of the clean-side air chamber 23 toward the outlet pipe 21 while gradually changing in flowing direction without reaching the inner surface 60 of the clean-side housing 2. Therefore, air flow A can flow into the outlet pipe 21 without being disturbed by the ribs 41, 42, 43.

On the other hand, when the air flow rate is high, there is a flow of air such as indicated by arrow B, that is, air flow B reaching the vicinity of the inner surface 60 of the clean-side housing 2 or flowing along the inner surface 60 in addition to the flow indicated by arrow B. In case the ribs 41, 42, 43 are not provided, air flow B causes disturbance of air flow inside the clean-side air chamber 23. However, by the ribs 41, 42, 43, air flow B is straightened so as to flow in the direction toward the outlet pipe 21, and it is possible to curb disturbance of air flow inside the clean-side air chamber 23 and reduce unevenness in flow velocity distribution of air flow inside the outlet pipe 21.

Figure 5:
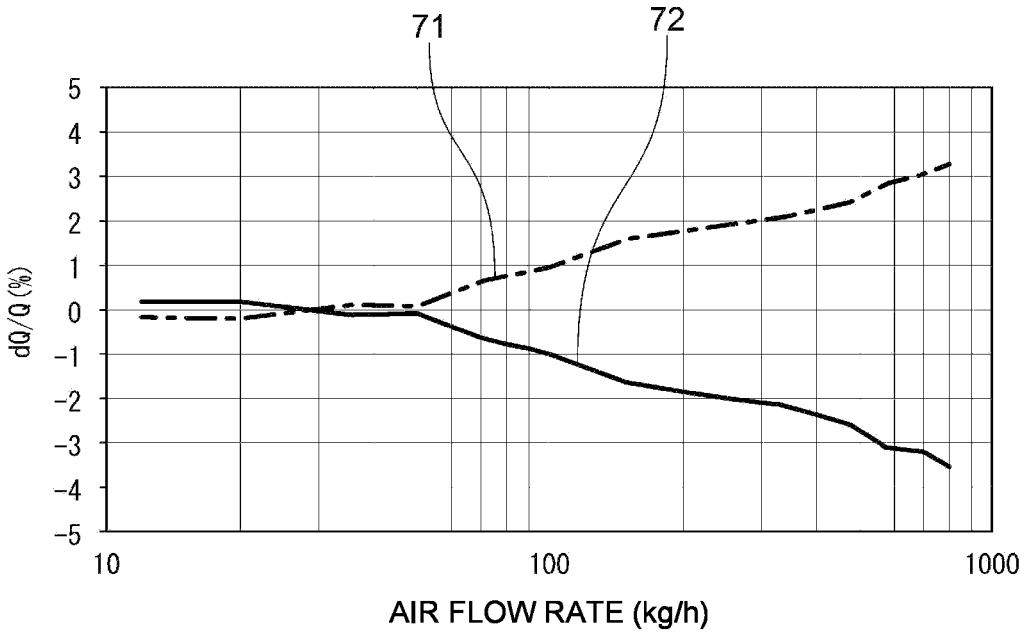
FIG. 5 is a diagram illustrating unevenness of air flow in a conventional air cleaner.
Figure 6:
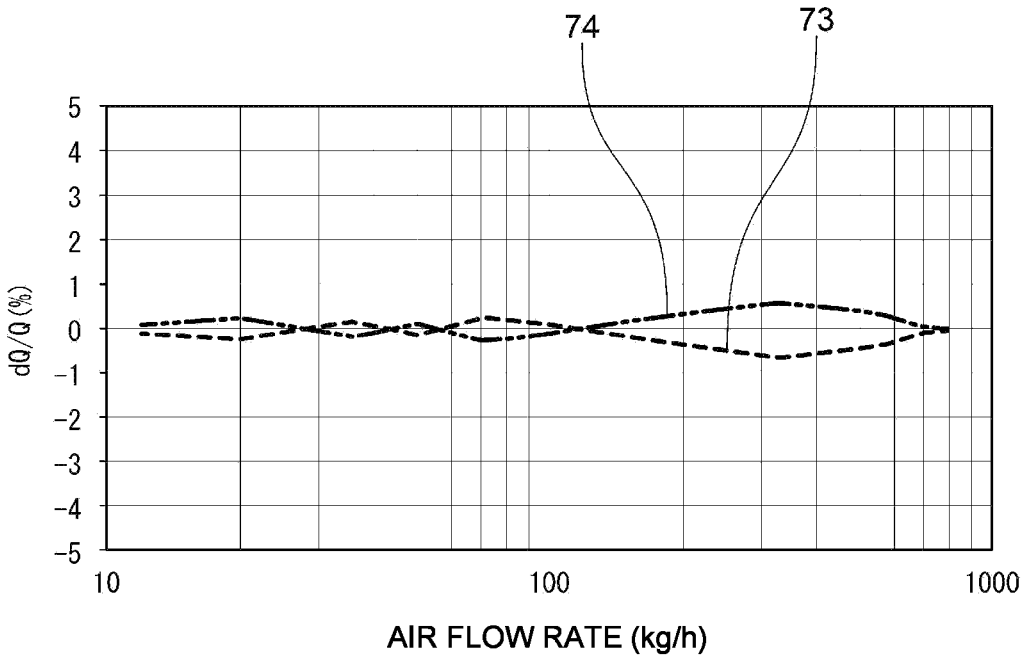
FIG. 6 is a diagram illustrating unevenness of air flow in an air cleaner according to the present invention.

FIG. 6 is a diagram indicating variation of values of measurement by the MAF sensor 22 before and after rotation of the filter element 4 attached to the air cleaner 1 by 180 degrees. In the figure, the abscissa axis represents a magnitude of an air flow rate and the ordinate axis represents ratios dQ/Q of deviations dQ of a measurement value before the rotation 73 and a measurement value after the rotation 74 to an average value Q of the values of measurement by the MAF sensor 22 before and after the rotation of the filter element 4. In comparison with dQ/Q when measurement was performed using a housing with no ribs, which is indicated in FIG. 5, it can be understood that ratios dQ/Q of deviations of measurement values are kept low from a range in which the air flow rate is low to a range in which the air flow rate is high. Accordingly, it can be understood that unevenness in flow velocity distribution in transverse section of the outlet pipe 21 is curbed and more accurate flow rate measurement is thus possible.

Although description on an air cleaner according to the invention of the present application has been provided above, the present invention is not limited to the above embodiment, but includes various modes included in the concept of the present invention and the claims. For example, the ribs 41, 42, 43 of the present embodiment are flat plate-like ribs and extend perpendicularly to the inner surface 60 of the housing 2 but may extend with an inclination in a direction not perpendicular to the inner surface 60 or may be ribs each including a curved surface.

The invention claimed is:

1. An air cleaner, comprising:

a filter element;

a housing defining an inner space, the inner space divided by the filter element into a dust-side air chamber on an upstream side and a clean-side air chamber on a downstream side;

the filter element arranged in the housing such that air introduced to the dust-side air chamber is filtered by the filter element, flows into the clean-side air chamber, and is discharged from an outlet pipe, to which an air flow sensor is attachable, connected to the clean-side air chamber;

the outlet pipe extending in a direction that is different from a normal to the filter element;

a plurality of ribs disposed on an inner surface of a clean-side portion of the housing that defines the clean-side air chamber;

the plurality of ribs extending from a corner portion of the housing toward the filter element and the outlet pipe and terminating short of a surface of the housing to which the outlet pipe is connected, the corner portion disposed spaced apart from the filter element and the outlet pipe; and wherein a distance between adjacent ribs of the plurality of ribs decreases in a direction toward the outlet pipe.

2. The air cleaner according to claim 1, wherein the plurality of ribs are provided integrally with the clean-side portion of the housing.

3. The air cleaner according to claim 1, wherein the plurality of ribs extend symmetrically with respect to an axis of the outlet pipe.

4. The air cleaner according to claim 1, wherein a respective end portion of each of the plurality of ribs, which is disposed adjacent to the outlet pipe, protrudes from the inner surface of the clean-side portion of the housing in a direction away from the outlet pipe.

5. The air cleaner according to claim 1, wherein the air flow sensor is coupled to the outlet pipe and projects into an outlet channel defined by the outlet pipe.

6. The air cleaner according to claim 1, wherein:

the housing includes a dust-side portion; and the dust-side portion of the housing and the clean-side portion of the housing are coupled to one another and collectively define the inner space.

7. The air cleaner according to claim 6, wherein the filter element is arranged between the dust-side portion of the housing and the clean-side portion of the housing.

8. The air cleaner according to claim 1, wherein a respective end face of each of the plurality of ribs is disposed adjacent to the outlet pipe and extends toward the filter element.

9. The air cleaner according to claim 1, wherein a respective end face of each of the plurality of ribs is disposed adjacent to and faces the filter element.

10. The air cleaner according to claim 1, wherein:

each of the plurality of ribs has a respective first end face disposed adjacent to the outlet pipe, a respective second end face disposed adjacent to the filter element, and a respective third end face;

the respective first end face extends toward the filter element;

the respective second end face faces the filter element; and the respective third end face extends between and connects the respective first end face and the respective second end face.

11. The air cleaner according to claim 1, wherein:

the clean-side portion of the housing includes a bottom and a plurality of walls extending around an outer perimeter of the bottom, the bottom including a first bottom portion and a second bottom portion;

the second bottom portion and a wall of the plurality of walls extend transversely to one another and are connected to one another along the corner portion;

the first bottom portion and the second bottom portion extend transversely to one another and are connected to one another along a second corner portion;

the outlet pipe is connected to and projects from the first bottom portion; and the plurality of ribs are disposed on the second bottom portion.

12. The air cleaner according to claim 11, wherein:

each of the plurality of ribs has a respective first end face disposed adjacent to the outlet pipe and a respective second end face disposed adjacent to the filter element;

the respective first end face projects from the second bottom portion, faces toward the outlet pipe, and is arranged spaced apart from the second corner; and the respective second end face projects from the wall and faces toward the filter element.

13. The air cleaner according to claim 11, further comprising at least one sidewall rib disposed on the inner surface, wherein:

a sidewall of the plurality of walls extends transversely to the first bottom portion and the second bottom portion, the sidewall connected to the first bottom portion along a third corner portion and connected to the second bottom portion along a fourth corner portion; and the at least one sidewall rib has a first end face projecting from the second bottom portion and a second end face projecting from the sidewall.

14. An air cleaner, comprising:

a housing including a dust-side housing and a clean-side housing connected to one another to define an inner space;

a filter element arranged within the inner space and dividing the inner space into a dust-side air chamber defined by the dust-side housing and a clean-side air chamber defined by the clean-side housing;

an outlet pipe in fluid communication with the clean-side air chamber and projecting from the clean-side housing obliquely relative to the filter element;

a plurality of ribs protruding from an inner surface of the clean-side housing toward the filter element, the plurality of ribs extending along the inner surface from a corner portion of the clean-side housing to a region adjacent to a surface of the clean-side housing via which the outlet pipe opens into the clean-side air chamber;

wherein a distance between adjacent ribs of the plurality of ribs decreases in a direction toward the outlet pipe; and wherein a respective first end face of each of the plurality of ribs, which is disposed adjacent to the outlet pipe, protrudes from the inner surface of the clean-side housing in a direction away from the outlet pipe.

15. The air cleaner according to claim 14, wherein a central longitudinal axis of the outlet pipe extends obliquely relative to the respective first end face of each of the plurality of ribs.

16. The air cleaner according to claim 14, further comprising an air flow sensor coupled to the outlet pipe and projecting into an outlet channel defined by the outlet pipe.

17. The air cleaner according to claim 14, wherein:

each of the plurality of ribs has a respective second end face disposed adjacent to the filter element;

the respective first end face extends toward the filter element; and the respective second end face faces the filter element.

18. The air cleaner according to claim 17, wherein:

the clean-side housing has a second inner surface extending transversely to the inner surface, the inner surface and the second inner surface of the clean-side housing abutting one another at the corner portion of the clean-side housing; and the respective first end face of each of the plurality of ribs abuts the inner surface and the respective second end face of each of the plurality of ribs abuts the second inner surface.

19. The air cleaner according to claim 18, wherein the plurality of ribs extend symmetrically with respect to a central longitudinal axis of the outlet pipe.

20. An air cleaner, comprising:

a housing including a dust-side housing and a clean-side housing connected to one another to define an inner space;

the clean-side housing including a bottom and a plurality of walls extending around an outer perimeter of the bottom, the bottom including a first bottom portion and a second bottom portion extending transversely to one another and connected to one another along a first corner portion;

a filter element arranged within the inner space and dividing the inner space into a dust-side air chamber defined by the dust-side housing and a clean-side air chamber defined by the clean-side housing;

an outlet pipe in fluid communication with the clean-side air chamber and projecting from the first bottom portion of the clean-side housing obliquely relative to the filter element;

a plurality of ribs protruding from an inner surface of the second bottom portion of the clean-side housing toward the filter element, the plurality of ribs extending along the inner surface from a second corner portion of the clean-side housing to a region adjacent to the first corner portion; and wherein a distance between adjacent ribs of the plurality of ribs decreases in a direction toward the outlet pipe.

* * * * *